United States Patent [19]

Hollins

[11] 4,079,973

[45] Mar. 21, 1978

[54] ADJUSTABLE CHAIN DOOR GUARD

[76] Inventor: Jesse R. Hollins, 40 Stoner Ave., Great Neck, N.Y. 11021

[21] Appl. No.: 782,008

[22] Filed: Mar. 28, 1977

[51] Int. Cl.[2] ..... E05C 17/36

[52] U.S. Cl. ..... 292/264

[58] Field of Search ..... 292/264, 265, 266, 268, 292/269

[56] References Cited

U.S. PATENT DOCUMENTS

| | | | |
|---|---|---|---|
| 252,309 | 1/1882 | Goebel | 292/264 |
| 2,076,605 | 4/1937 | West | 292/264 |
| 3,920,273 | 11/1975 | Scholtze | 292/264 |

FOREIGN PATENT DOCUMENTS

| | | | |
|---|---|---|---|
| 321,918 | 6/1920 | Germany | 292/264 |
| 17,447 of | 1889 | United Kingdom | 292/264 |

*Primary Examiner*—Richard E. Moore

*Attorney, Agent, or Firm*—Kirschstein, Kirschstein, Ottinger, Frank & Cobrin

[57] ABSTRACT

A chain door guard which is constructed in a manner so that the chain coupler element can be set into a position of the slot member wherein the chain has limited slack. The coupler element, when positioned in the slot member that keeps the chain substantially taut, limits the opening of the door to a minimal distance. Limiting the opening of the door to a minimal distance will provide greater protection of the premises for it will not allow sufficient open space between the door and the door frame, when the door is opened, to allow a chain cutter or jimmy to be used in cutting or breaking the chain. In addition, the construction of this chain guard provides for a person to alternatively set the chain coupler element into the long slot of the slide bracket. Thus the chain will have a maximum of slack in this disposition of the coupler element, thus allowing the door to be opened sufficiently for the occupant of the premises to see and converse with someone standing at the outside of the door.

2 Claims, 10 Drawing Figures

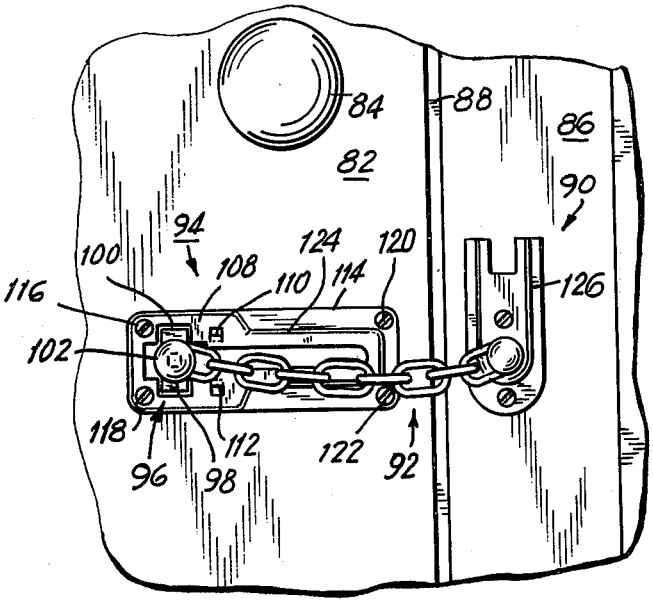
FIG. 7
FIG. 8
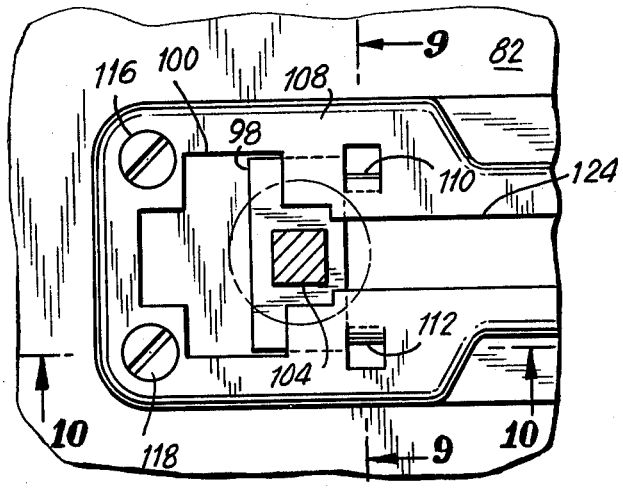
FIG. 9
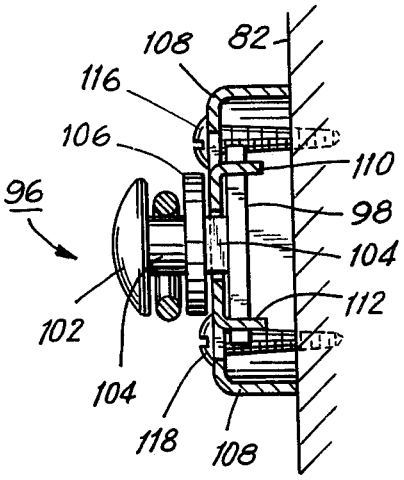
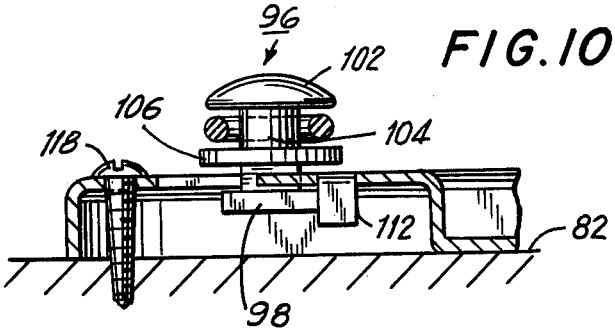
FIG. 10

ADJUSTABLE CHAIN DOOR GUARD

BACKGROUND OF THE INVENTION

1. Field of the Invention

The present invention relates to chain door guards.

2. Description of the Prior Art

The provision of a chain door guard which when in use allows a door to be opened a substantial distance, so that the occupant can see and converse with a person outside the door, yet restricting this person from entering the premises, has been known for many years. Such chain door guards enable doors to be opened to an ajar position while still restraining entry of those outside of the door. The conventional chain door guard serves an adequate and useful purpose, however the constructions of these standard units of the prior art allows the door to be opened sufficiently so that there is a space between the door edge and the door casing. A burgler who succeeds in opening a lock which may be present on the door is clearly not adequately restrained from entry into a house or an apartment by a conventional chain door guard, since the spacing present when the door is ajar as restrained by the chain allows a burgler to insert a pry tool or cutting device and thereby to break or clip the chain. Thus it will be seen that it would be desirable to have a chain door guard of such a configuration that a burgler or the like attempting to enter the chain protected area cannot as readily damage or destroy the chain door guard or rip it off from its mounting on the door or on the door casing as can be done to the conventional chain door guard.

In the conventional chain door guard, basically three elements are present. A slide bracket is installed on the interior surface of the door, and this slide bracket is generally horizontally oriented with a horizontal slot therein having an enlargement at the slot end farthest from the edge of the door. The other end of the slide bracket is generally at or near the edge of the door which is juxtaposed with the door casing. The second element in the conventional chain door guard is a chain anchor bracket which is attached to the door casing at a point opposite to the slide bracket. The third basic element in the conventional chain door guard is the chain, one end of the said chain is permanently swiveledly attached to the chain anchor bracket. The other end of the chain has a fitting, known as a coupler or coupling element, extending through the end link so that the coupling element may be inserted into the enlargement at the end of the slot in the slide bracket and thereafter the coupling element may be manually slid along the slot so that the chain is slidably mounted on the slide bracket. It is apparent when the coupling element at the end of the chain is moved to a position in the slot closest to the door casing, there is considerable slack in the chain which allows the door to be opened, possibly of from three to four inches, between the door edge and the door casing. Thus the door can be opened sufficiently for one to see and converse with the person on the outside of the premises, yet offer protection against forced entry into the premises.

However the allowable door opening of the space of 3 to 4 inches has the disadvantage that a burgler who is skilled in opening the door lock can open the door sufficiently with certain tools to cut the chain or even to force pry the chain element loose from the door frame thus gaining free entry into the premises.

Typical prior art in this field will now be discussed. U.S. Pat. No. 3,161,035 deals with a keyed lock member associated with the door frame assembly, whereby the chain assembly can be engaged in the keyed lock member by having the door somewhat open (ajar), so that one can grab the free end of the chain, and enter it into the keyed lock member, then close the door and lock it with the standard lock hardware that the door is fitted with. When unlocking the door, the person would unlock the door first, push it open to the extent the chain would allow, put the key in the door chain lock member, unlock same, and the chain would fall away from the chain lock member, thus freeing the chain from its lock member, allowing the door to be swung fully open and allowing the person to enter the premises.

U.S. Pat. No. 3,275,364 shows a slotted section having an angular hook section fabricated in the slotted section about midway of said slot, with the hook facing forward in the slot member. Thus the chain, upon entering the slot at the enlarged cut out section 10, can move forward without restriction; yet the chain cannot be disengaged from the slot freely unless the coupler element, being spring loaded 25 is depressed manually and slid under the extreme tip of the hook member.

U.S. Pat. No. 3,395,556 deals with a chain lock member which is quite similar to that shown in U.S. Pat. No. 3,161,035 described supra, in addition to which is added the hook member as shown in U.S. Pat. No. 3,275,364 described supra.

SUMMARY OF THE INVENTION

1. Purposes of the Invention

It is an object of the present invention to provide an improved chain door guard.

Another object is to provide a chain door guard wherein the chain coupler element or member can be inserted in the slide member wherein the chain will have limited slack.

Another object is to provide a chain door guard wherein the chain coupler element or member can be inserted in the chain slide member wherein the chain will have a maximum of slack.

A further object is to provide a chain door guard with restraint means so that the chain may be positioned so as to remain substantially taut even if the door is unlocked and consequently so that the edge of the door cannot be displaced away from juxtaposition with the door casing.

Still another object is to provide a chain door guard in which the chain may be alternatively restrained into substantially taut position, or disposed in a slack position while connected to the slide bracket, or alternatively the chain may be completely disconnected from the slide bracket.

Still a further object is to provide a chain door guard which provides improved security for the occupant of the premises by effectively preventing a door from being displaced away from its door casing, through the provision of restraint means for the chain, so that the chain coupler element or member may be positioned with the chain having limited slack thus effectively keeping the door closed.

These and other objects and advantages of the present invention will become evident from the description which follows.

2. Brief Description of the Invention

In the present invention, the adjustable chain door guard includes a slide bracket, a chain anchor bracket and a chain in combination, with a main element of novelty residing in the specific configuration of the slide bracket and/or the coupler element at the free end of the chain. One end of the chain is attached to the chain anchor bracket, which in turn, when the device is installed on a door, will usually be attached to the door casing or door jamb. The slide bracket has a slot, and the slide bracket, when the device is installed on a door, will usually be attached to the door with a slot transverse or perpendicular to the door edge or to the interface or joint between the door and the door frame, casing or jamb. In most instances, the aforementioned interface or joint will be vertical and the slot of the slide bracket will be substantially horizontal or inclined at an acute angle from the horizontal, typically 10° to 30° as deemed most suitable. A coupler element as mentioned supra, which in most instances is a fitting having an enlargement at each end and a narrow waist, is provided at the other or free end of the chain. The end link of the chain circumscribes the narrow waist of the coupler element so that the coupler element is attached to the end of the chain but some play is possible between the coupler element and the end link of the chain, so that the coupler element is slidably mountable in the slot in the slide bracket. Typical configurations of coupler elements are shown and described in the patents cited supra, and two embodiments of coupler elements feasible for utilization in the present invention will be described infra.

An important aspect of the present invention is that the one end of the slot in the slide bracket which is spaced away from the door frame, casing or jamb, is provided with means to restrain the coupler element, so that when the chain anchor bracket is attached to the trim of a door casing, frame or jamb, and when the slide bracket is attached to the door mounted in the door casing or the like (with the other end of the slot in the slide bracket adjacent to the door casing), and when the aforementioned coupler element at the other end of the chain is disposed in the restraint means, the chain is substantially taut with limited slack, so that the edge of the door cannot be displaced away from juxtaposition with the door casing, i.e., no spacing of any substantial magnitude is possible at the joint or interface between the door and the door casing, frame or jamb. In other words, in effect the chain acts in this disposition in a manner similar to a bolt, lock, or other positive closure of the door.

In an alternative disposition of the coupler element, i.e., when the coupler element is manually displaced from the restraining means and into the slot, the coupler element and the free end of the chain may be slid along in the slot and towards the door frame, casing or jamb, so that considerable slack is provided in the chain, and the door, while still restrained, may be slightly opened to an ajar position so that there is a spacing, possibly of from 3 to 4 inches, between the door edge and the door casing, frame, jamb or the like.

In another alternative disposition of the coupler element, this coupler element may be slid in the slot away from the door casing or jamb to the extreme one end of the slot, and then out of contact with the slide bracket, so that the chain hangs free and the door may be fully opened.

In one embodiment of the invention, the means to restrain the coupler element at the other end of the chain in the one end of the slot in the slide bracket is a second slot in the slide bracket, which second slot extends at an angle from the one end of the aforementioned slot in the slide bracket in which the coupler element at the other end of the chain is slidably mounted. This angle is preferably about 90°, i.e., the second slot extends generally perpendicularly from the one end of the main aforementioned slot in the slide bracket. Typically the second slot will have a terminal extension which extends towards the other end of the main or principal slot in the slide bracket, this main or principal slot being the aforementioned slot in which the coupler element is slidably mountable. In a preferred embodiment, the terminal extension of the second slot will be curved to best accommodate for the motion of the coupler element during emplacement, i.e., when the coupler element is emplaced in this embodiment of restraining means, the chain will sweep or pivot about its mounting on the chain anchor bracket, which in effect serves as a center of rotation of the chain. It will be appreciated that in this instance the chain does not rotate about this center of rotation to any appreciable degree; typically an actual angular displacement of less than 5° between the main slot in the slide bracket and the chain will be attained when the aforementioned form of restraining means is employed. In a further preferred embodiment of this type of restraining means, a third slot may be provided opposite to the second slot in the slide bracket, so that a universal slide bracket is provided which is usable for both right-handed and left-handed doors, i.e. either for doors which open counter-clockwise when viewed in plan view, or for doors which open clockwise in plan view. In this case, the third slot will usually be an identical mirror image of the second slot.

In an alternative embodiment of the adjustable chain door guard of the present invention, the means to restrain the other end of the chain is an oblong coupler element member on the other end of the chain, together with a transverse opening at the one end of the slot. Specific coacting configurations of these structural features are provided. The oblong coupler element member has a length greater than its width, and this width of the oblong coupler element member is less than the width of the slot, so that when the oblong member is disposed in the slot with the longer axis of the oblong member substantially coaxial with the axis of the slot, the other end of the chain, i.e., the oblong coupler element member, is slidably mounted in the slot. The length of the oblong coupler element member is greater than the width of the slot, and the length of the transverse opening at the one end of the slot is greater than the length of the oblong member, so that when the oblong coupler element member is disposed in the transverse opening transversely to the slot, the chain is substantially taut, and the new result of the present invention is thus attained. In a preferred embodiment, the oblong coupler element member and the transverse opening will be rectangular.

The present invention provides several salient advantages. An improved chain door guard is provided, in which the chain coupler or coupling element or member can be inserted in the slide bracket member in such a way that the chain will have a minimum of slack; or alternatively greater or maximum slack, in which latter case the door may be opened to an ajar position, or alternatively the chain coupling element can be completely separated from the slide bracket so that the chain hangs free and the door may be opened wide. The restraint means of the present chain door guard permits the chain to be positioned so as to remain substantially taut even if the door is unlocked, and consequently so that the edge of the door cannot be displaced away from juxtaposition with the door casing. Although this latter advantage is a specific new result, the invention is generally advantageous in that the chain may be alternatively restrained into substantially taut position, or disposed in a slack position while connected to the slide bracket, or alternatively the chain may be completely disconnected from the slide bracket. Thus the present chain door guard provides improved security for the resident, or an occupant within an enclosure having a door or the like, by effectively preventing the door or the like from being displaced away from its door casing, frame or jamb, through the provision of restraint means for the chain of the chain door guard, so that the chain coupler element or member may be positioned with the chain having limited or negligible slack, thus effectively keeping the door closed.

The invention accordingly consists in the features of construction, combination of elements, and arrangement of parts, which will be exemplified in the device hereinafter described and of which the scope of application will be indicated in the appended claims.

BRIEF DESCRIPTION OF THE DRAWINGS

In the accompanying drawings in which are shown several of the various possible embodiments of the invention:

FIG. 7 shows an alternative embodiment of restraint means;

FIG. 8 is an enlarged view of the restraint means portion of FIG. 7;

FIG. 9 is a sectional elevation view taken substantially along the lines 9—9 of FIG. 8; and FIG. 10 is a bottom sectional plan view taken substantially along the lines 10—10 of FIG. 8.

DETAILED DESCRIPTION OF THE PREFERRED EMBODIMENTS

Figure 1:
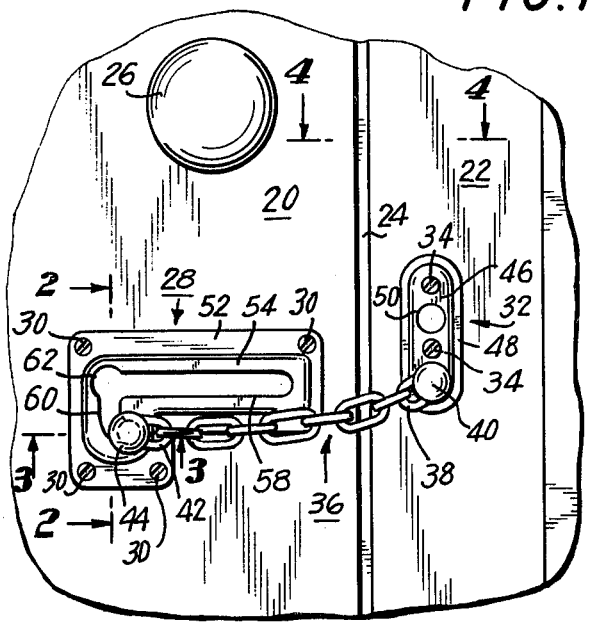
FIG. 1 is an elevation view of one embodiment of the chain door guard of the invention, with the coupler element in the restraint means so that the chain is taut.
Figure 4:
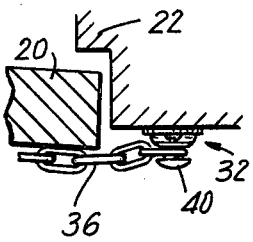
FIG. 4 is a sectional plan view taken substantially along the lines 4—4 of FIG. 1.

Referring now to FIGS. 1-5 inclusive, a door 20 is juxtaposed with a casing, jamb or frame 22; with an interface or joint 24 between the door 20 and the casing 22. The door 20 is typically provided with a doorknob 26, which in suitable instances may alternatively consist of a latch, handle or the like. The elements or members of the chain door guard of the invention consist of a slide bracket 28 secured to the door 20 by means of screws 30, a chain anchor bracket 32 secured to the door casing 22 by means of screws 34, and a chain 36 which extends in a taut disposition between the brackets 28 and 32. The one end link 38 of the chain 36 is secured to the chain anchor bracket 32 by means of a bolt or rivet 40, in a manner known to those skilled in the art. Thus, when the chain other end, at link 42 and coupler element 44, is free of contact with (and mounting in) the slide bracket 28, the chain 36 will hang free from the bolt 40. Chain anchor bracket 32 is of the usual configuration for such elements, i.e., a raised central portion 46 extends outwards and the perimeter of portion 46 is defined by an annular lip 48 which contacts the surface of casing 22. A hole 50 is provided in portion 46 so that the coupler element 44 at the other end of the chain 36 may be mounted in hole 50 when it is desired to open the door; this disposition of the chain 36 keeps it out of the way of movement of the door during complete opening (and subsequent closing) of the door.

Figure 5:
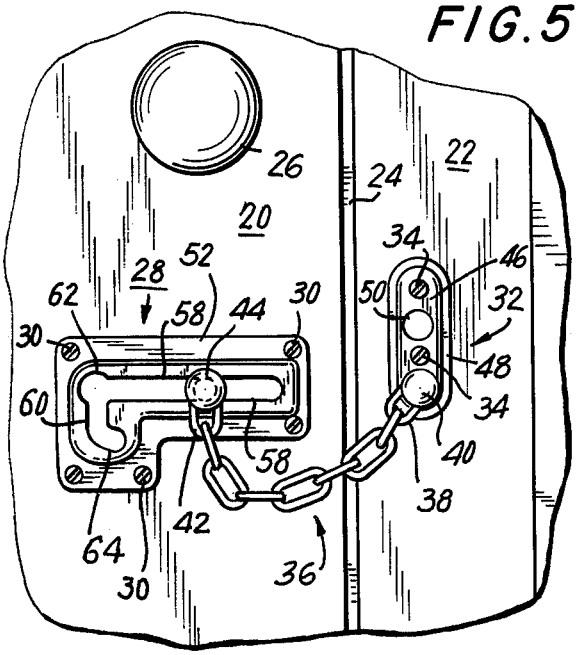
FIG. 5 shows the chain door guard of FIG. 1 with the chain in slack position; the coupler element is disposed in the main slot of the slide bracket.

The slide bracket 28 consists of a flat outer peripheral portion 52 which lays flat against the door 20; the screws 30 hold portion 52 against the surface of door 20. Slide bracket 28 includes a central raised portion 54 defining a pocket or compartment within which the circular inner end flange 56 of coupler element 44 may be moved or manipulated to a suitable disposition. The raised portion 54 of slide bracket 28 is characterized by the provision of a main slot 58, which functions per se in a manner comparable to the usual slot in a slide bracket of a chain door guard. In this regard, FIG. 5 shows the chain 36 in a slack disposition, with the coupler element 44 slidably engaging the slide bracket 28 along slot 58, so that the door 20 may be opened to an ajar position. This is to be contrasted to the disposition of the chain 36 in FIG. 1, wherein the chain is taut in accordance with the present invention, since the coupler element 44 has been disposed in suitable means to restrain this coupler element, which in this case consists of an ancillary slot 60 which depends perpendicularly downwards from the back end of the main slot 58, this back end of slot 58 also being provided with a substantially circular enlargement 62 to accommodate for the insertion of flange 56 into the slots. The specific configuration of the ancillary slot which is preferred is best shown in FIG. 5, where the ancillary slot 60 terminates with a laterally curved extension 64, which curves towards the interface 24.

Figure 2:
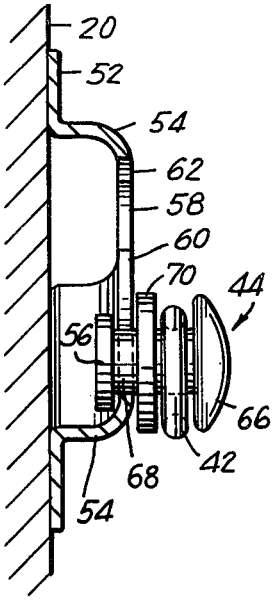
FIG. 2 is a sectional elevation view taken substantially along the lines 2—2 of FIG. 1.
Figure 3:
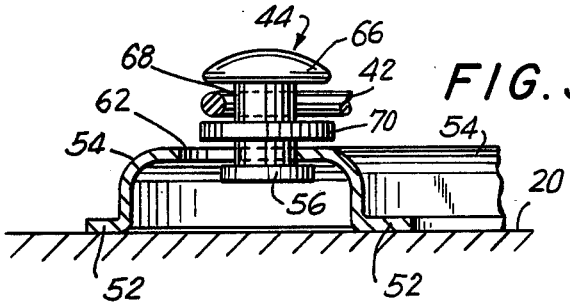
FIG. 3 is a bottom sectional plan view taken substantially along the lines 3—3 of FIG. 1.

Referring specifically to FIGS. 2 and 3, the configuration of the coupler element 44 is basically that of a rivet or bolt which is freely mounted in chain link 42. The coupler element 44 thus has a head 66, a shank 68, the terminal flange 56 mentioned supra and an intermediate annular flange 70 which is interposed between chain link 42 and flange 56 so that the chain link 42 cannot interfere with the motion of the coupler element 44, and specifically the sliding motion of the inner end of the shank 68 and flange 56 within the slots 58 or 60. The disposition of slots 60 and 64 as shown in FIGS. 1 and 5 is the typical disposition of these elements in instances where the door 20 opens in a clockwise direction in plan view, i.e., gravity keeps the coupler element 44 in position. It will be appreciated that in some instances, the door to be secured may open in counter clockwise direction. In this case, the slot 60 would extend in an opposite direction than that shown in FIGS. 1 and 5 and the mounting of the slide bracket 28 would be on the opposite side of the chain anchor bracket 32, i.e., the positions of members 28 and 32 as well as that of members 20 and 22 would be reversed.

Figure 6:
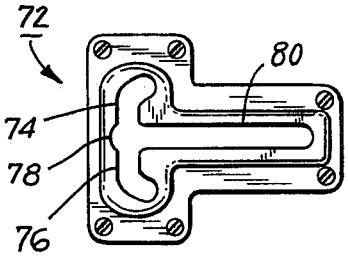
FIG. 6 shows an alternative embodiment of the slide bracket.

A universal slide bracket is shown in FIG. 6. Here the slide bracket 72 has ancillary slots 74 and 76 on opposite sides of the rear end enlargement 78 of the slot 80. Thus the slide bracket 72 can accommodate for mounting either on a door which opens in a clockwise or in a counter clockwise direction.

Referring now to FIGS. 7, 8, 9 and 10, an alternative embodiment of the invention is shown. FIG. 7 shows a door 82 having a handle or knob 84, and door casing or frame 86, and the interface 88 between members 82 and 86. A chain anchor bracket 90, a chain 92, and a slide bracket 94 are also shown in FIG. 7. The chain 92 is characterized by having, at its free end, a coupler element 96 of a unique configuration, which entails the provision of a rectangular member 98 which has been extended via a transverse rectangular opening 100 into a chain lock position so that the chain 92 is substantially taut with very little slack. The coupler element in this case includes not only rectangular inner element 98 which is a flat member, but also as best shown in FIGS. 9 and 10, the coupler element 96 includes a head 102, a shank 104, the inner portion of which is a square cross-section as best shown in FIG. 8, and a partition flange 106 having a function comparable to flange 70 described supra. The raised section 108 of slide bracket 94 includes two stops 110 and 112 which have been punched out of the surface of raised section 108 during forming of the slide bracket. The purpose of stops 110 and 112 is to prevent excessive movement of the coupler element 96 towards the interface 88 and to keep the chain 92 taut, when member 98 is disposed parallel to opening 100. The slide bracket 94 also includes, about a portion of its periphery, a flat lip 114 which presses against the surface of door 82. Mounting screws 116, 118, 120 and 122 are provided.

When it is desired to provide a limited amount of slack in chain 92 so that door 82 may be slidingly opened to an ajar position, the head 102 is grasped and the coupler element 92 is manually rotated by 90°, so that subsequent manipulation of the coupler element 96 will permit section 104 to slide along slot 124 in slide bracket 94, so that chain 92 may assume a disposition comparable to the disposition of chain 36 shown in FIG. 5. The chain anchor bracket 90 is of a configuration which accommodates for the insertion of the rectangular element 98 from above into a slot 126, when it is desired to open the door 82.

It is to be noted that the installation procedure for the device of the present invention is divergent from prior art sequences. In the present invention, the chain anchor bracket is installed first, before the slide bracket. As discussed supra, the chain anchor bracket is installed on the door frame, casing or jamb. Then, the chain, one end link of which is swiveledly attached to the chain anchor bracket, is extended to its full distance. The slotted slide bracket is next attached to the door in a position so that the coupling element of the chain enters the enlarged area of the slot member of the chain slide bracket with minimal slack, so that when the coupler or coupling element is in the restraining means contiguous or juxtaposed with this enlarged area, the chain is substantially taut.

It thus will be seen that there is provided an article of manufacture which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. An adjustable chain door guard comprising a chain anchor bracket and a chain, one end of said chain being attached to said chain anchor bracket, a slide bracket, said slide bracket having a slot, a coupler element at the other end of said chain being slidably mountable in the slot in said slide bracket, one end of the slot in said slide bracket having means to restrain the other end of said chain, said means to restrain the other end of the chain being an oblong coupler element member on the other end of the chain, said oblong coupler element member having a length greater than its width, the width of said oblong coupler element member being less than the width of said slot, the length of said oblong coupler element member being greater than the width of the slot, together with a transverse opening at the one end of the slot, said transverse opening having a length greater than the length of said oblong coupler element member, so that when said chain anchor bracket is attached to the trim of a door casing and said slide bracket is attached to the door mounted in said door casing, with the other end of the slot in said slide bracket adjacent to said door casing, and when said oblong coupler element at the other end of said chain is disposed in the transverse opening transversely to the slot, said chain is substantially taut with limited slack, so that the edge of said door cannot be displaced away from juxtaposition with said door casing, and when said oblong coupler element member is disposed in the slot with the longer axis of said oblong coupler element member substantially coaxial with the axis of the slot, the other end of the chain is slidably mounted in the slot.

2. The adjustable chain door guard of claim 1 in which the oblong coupler element member and the transverse opening are rectangular.

* * * * *